United States Patent [19]

McMillan

[11] 4,385,289

[45] May 24, 1983

[54] TRAILER TEMPERATURE SENSING ALARM FOR REFRIGERATED TRUCKS

[76] Inventor: Billy J. McMillan, 104 W. Central, Warren, Ark. 71671

[21] Appl. No.: 260,202

[22] Filed: May 4, 1981

[51] Int. Cl.[3] ..... G08B 21/00; B60Q 1/00

[52] U.S. Cl. ..... 340/585; 340/57; 340/506; 340/514; 340/586

[58] Field of Search ..... 340/585, 586, 57, 594, 340/506, 514, 533

[56] References Cited

U.S. PATENT DOCUMENTS

| | | | |
|---|---|---|---|
| 2,753,548 | 7/1956 | Gates | 340/594 |
| 3,223,805 | 12/1965 | Gibson | 340/594 |
| 3,363,231 | 1/1968 | Grosgebauer et al. | 340/57 |
| 4,024,495 | 5/1977 | O'Brien | 340/57 |

*Primary Examiner*—Glen R. Swann, III

*Attorney, Agent, or Firm*—Stephen D. Carver

[57] ABSTRACT

An alarm system for sensing temperature in a refrigerated truck trailer and for providing warning when trailer temperature exceeds one of a plurality of selectable monitor temperatures. The system includes a sensor bank adapted to be positioned within the refrigerated compartment being monitored. A control module, preferably positioned within the truck cab in proximity to the owner or driver, is electrically interconnected therewith. The control module is adapted to be switched between test, off and alarm modes. In the test mode a visual and audio indicator provides a test warning. In the alarm mode the circuit will warn the driver when the temperature within the refrigerated compartment exceeds the target temperature selected by a temperature select switch. To initiate operation of the alarm system, a set indicator provides a constant warning until the remote sensor units cool below their trigger point. After the set warning ceases, the alarm may be switched into the alarm mode to thereafter constantly monitor the refrigeration compartment.

1 Claim, 2 Drawing Figures

TRAILER TEMPERATURE SENSING ALARM FOR REFRIGERATED TRUCKS

BACKGROUND OF THE INVENTION

The present invention relates generally to temperature sensing devices. More particularly, the present invention relates to an automatic system for providing a warning to a truck driver when his refrigerated load has warmed to an unacceptable temperature.

As will be appreciated by those skilled in the art, trucks equipped to haul various food products long distances must be equipped with appropriate refrigeration capabilities. Like other mechanical systems, the refrigeration units employed with over-the-road trucks may periodically break down or otherwise require minor repairs or maintenance. Unfortunately, when refrigeration problems occur in an unforeseen fashion or at an unexpected time, the refrigerated contents of the truck may perish if critical repairs are not effectuated within predetermined time limits. Therefore, where an early warning of a temperature rise is provided, the trucker may save his load and avoid the otherwise costly losses associated with spoilage.

Previously the internal temperature of refrigerated truck compartments has been monitored by remote gauges mounted on an exterior portion of the trailer. The trucker must stop the truck and get out of the cab to view the gauges. When a refrigeration breakdown occurs, several hours may pass before the trucker discovers the temperature rise when he inspects the gauges. As a practical matter precision readings of refrigeration compartment temperatures are unnecessary. Moreover, an audio and visual signal triggered by a temperature rise over a preselected or predetermined set temperature can hardly be ignored when it is observable within the drivers cab.

SUMMARY OF THE INVENTION

The present invention comprises a temperature sensitive alarm system primarily adapted for installation in refrigerated over-the-road trucks. The system continuously and reliably monitors the temperature within the refrigeration compartment, and provides an audio and visual signal when certain temperature limits are exceeded.

Preferably, the alarm comprises a sensor bank comprising a plurality of separate sensing circuits having thermostatic elements, each element set for a different temperature. The sensor bank is preferably mechanically secured within the refrigeration compartment. The alarm system is controlled by an alarm control circuit preferably wired within a control housing mechanically secured in proximity to the driver or operator within the cab. The control circuit is interlinked with the remote sensor bank by an elongated, heavy duty cable system extending from the cab to the trailer.

The alarm control circuitry is switchable between "off", "test", and "alarm" modes. Three independent sensing or alarm transducers are wired into the control circuit, and mechanically secured to the control housing.

The temperature sensing module thermostatic elements are operable to close electrical contacts at different operating temperatures. The control circuit module includes a temperature selecting switch which interconnects the circuit with a desired thermostatic element. Thus the "trigger temperature" which will initiate an alarm may be varied by the operator or driver. More particularly, where only minor temperature changes are encountered or sensed, it will be apparent that the driver need merely select a higher trigger temperature to maintain refrigeration section monitoring control. Moreover, unless significant temperature changes occur, no bothersome and ambiguous alarm signal will be generated to annoy or confuse the driver.

The first indicator transducer warns when the alarm circuit is set. For example, after initial installation of the alarm, the temperature sensors must have an opportunity to cool to the refrigeration compartment temperature. Also, after operation of the refrigeration compartment is commenced, time must be allowed for the compartment and the sensors disposed therewithin to cool. During this "cooling interval" the "set" indicator will provide a warning.

Another indicator transducer is operable to warn when temperature within the refrigerated compartment is excessive, providing the control circuit is in the "alarm" mode, and the remote sensors have initially cooled (in the "set" stage). The primary transducer circuit comprises a light and an audio transducer, whereby to provide visual and audio warnings to the operator. Importantly the unit may be switched to the test mode to actuate the primary warning transducer as long as power is applied to the network. Tests may occur completely independently of the interconnection of the remote sensors.

The third indicator system monitors source power when the alarm circuit is in the alarm mode completely independently of sensed temperature (as long as power is applied to the unit). During installation this feature enables the technician to insure that power is properly applied to the control module, independently of the wiring or installation of the temperature sensing module. Along these lines, the installing technician also benefits from the fact that the previously mentioned primary transducer system may be tested independently of the temperature sensing module.

Thus an object of the present invention is to provide a temperature sensing device for monitoring a refrigerated compartment.

A more particular object is to provide a sensing device adapted to be employed with over-the-road trucks, which will provide a visual and audio warning to the driver or operator within his cab when temperature within his trailer rises above predetermined acceptable limits.

Another object of the present invention is to provide a temperature warning or alarm device of the character described adapted for use with refrigeration equipment of varying designs, capacities, and characteristics.

Another object of the present invention is to provide a warning system of the character described characterized by extreme mechanical and electrical reliability.

A still further object of the present invention is to provide an alarm system which may be quickly and easily installed.

Another object is to provide an alarm system capable of warning the driver, operator or technician installing the device of a variety of electrical conditions.

A still further object of the present invention is to provide a warning system which will be inconspicuous and which need not be continuously observed when in the "alarm" mode.

These and other objects and advantages, along with features of novelty appurtenant thereto, will appear or become apparent in the course of the following descriptive sections.

BRIEF DESCRIPTION OF THE DRAWINGS

In the appended drawings, which form a part of the specification and which are to be construed in conjunction therewith, and in which like reference numerals have been employed throughout to indicate like parts in the various views.

DETAILED DESCRIPTION OF THE DRAWINGS

Figure 1:
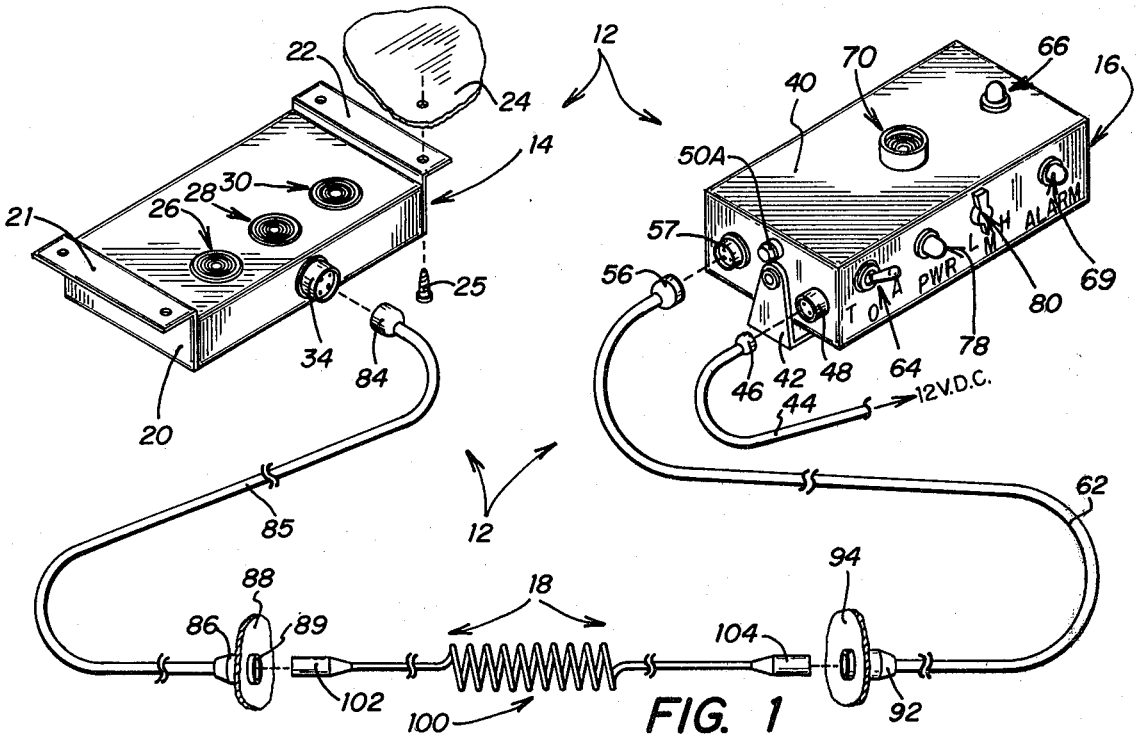
FIG. 1 is an isometric and pictorial view illustrating a temperature actuated alarm system constructed in accordance with the teachings of the invention; and, FIG. 2 is an electrical schematic diagram thereof.

With reference now to the appended drawings, a temperature sensitive alarm system constructed in accordance with the teachings of the present invention is generally designated by the reference numeral 12. System 12 comprises a sensor module, generally designated by a reference numeral 14, which is adapted to be secured within a refrigerated compartment, and a control module, generally designated by the reference numeral 16, which controls the alarm apparatus. Module 16 is adapted to be disposed within the truck cab in proximity to an operator or driver for providing warnings of temperature condition. Units 14, 16 are interconnected by a cable network generally designated by the reference numeral 18. A temperature sensing network generally designated by the reference numeral 14A is housed within module 14. The electrical alarm control circuit, generally designated by the reference numeral 16A, is wired within control cabinet 16.

The sensor module 14 comprises a generally rectilinear cabinet 20 preferably formed of rigid sheet metal, aluminum or the like. Cabinet 20 includes a pair of spaced-apart flanges 21, 22 which are adapted to be secured to a convenient surface 24 or frame member within the refrigeration compartment. To this effect a plurality of conventional sheet metal screws 25 may be employed. Module 14 includes a plurality of temperature sensing, thermostatic elements 26, 28, and 30 which are electrically interconnected with a conventional electrical terminal plug 34. The thermostatic elements 26, 28, and 30 are triggered when temperature exceeds 45 degrees, 40 degrees, or 28 degrees respectively.

The control module 16 is also of generally rectilinear dimensions, comprising a plastic, sheet metal or metallic cabinet 40 adapted to be rigidly secured within the cab of the truck or upon another location by a conventional mounting bracket 42. As illustrated in FIG. 1, control module 16 is interconnected with sensor module 14 via cable network 18, which will later be discussed.

Circuit 16A (FIG. 1) is powered by nominally 12 volt to 14 volt direct current supplied from the vehicle electrical system via a cable 44 which terminates in conventional electrical plug 46. Plug 46 is adapted to be mated with plug 48 (secured to cabinet 16) to apply power through a conventional fuse 50 (housed within fuse mount 50A) and lines 53, 49 across buss lines 52, 54. Another conventional electrical plug 56 is adapted to be coupled to plug 57 mounted to cabinet 16. Plug 56 communicates with cable network 18 via cables 62.

Figure 2:
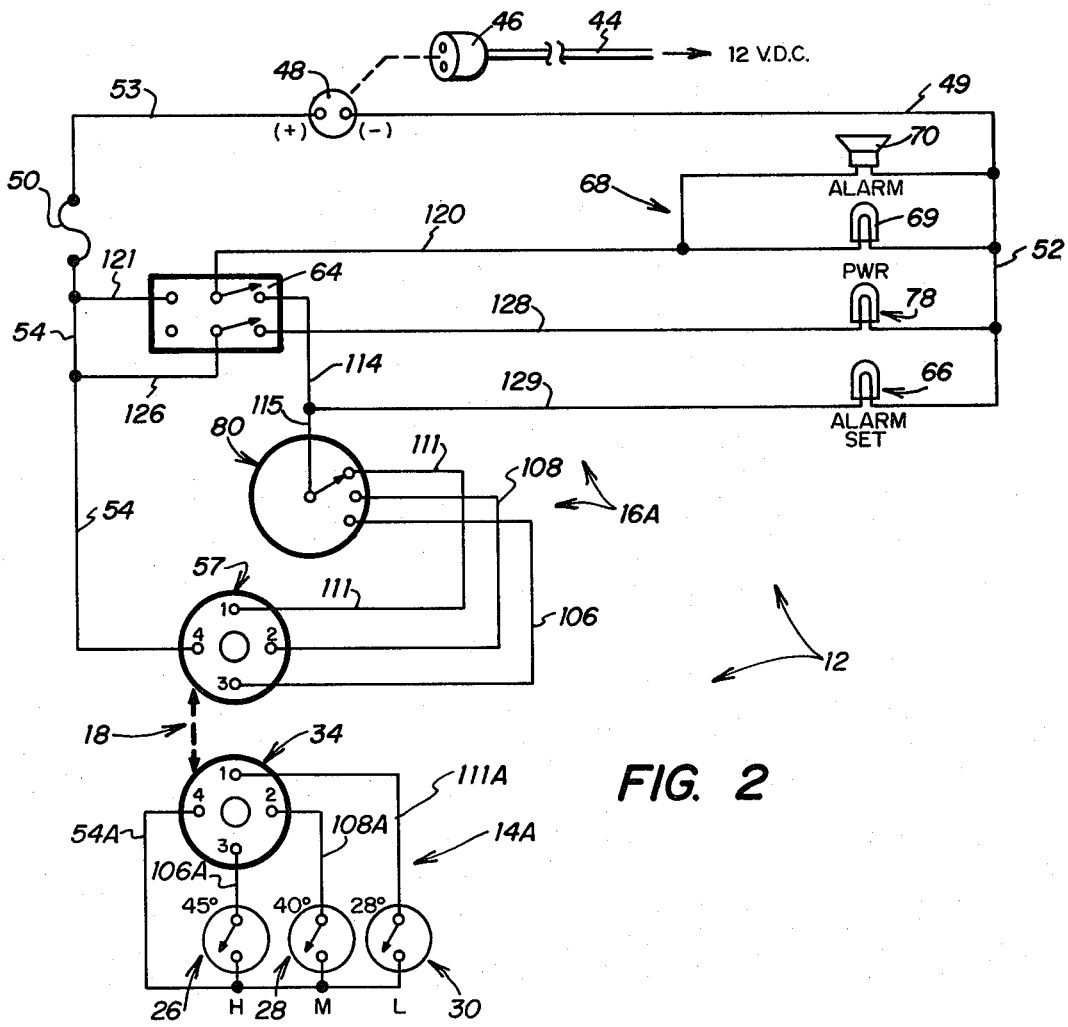

With primary reference directed now to FIG. 2, a double pole, double throw mode control switch 64 is employed to switch circuit 16A between "off", "test", and "alarm" modes. Circuit 16A includes a first indicator means 66 which is extinguished when the trailer cools to below the alarm temperature to indicate the alarm circuit is properly set independently of the operation of other sensors or of switch 64, and a second primary indicator or warning means generally indicated by the reference numeral 68. The Circuit also includes a third warning indicator means generally designated by the reference numeral 78 for providing a warning of proper operating power during the alarm mode operation of the circuit 16A.

The alarm circuit transducer 68 comprises a light 69 and an audio transducer 70 connected in parallel therewith. Indicator systems 66, 78 also preferably comprise conventional 12 volt warning lights. A multi-position rotary switch 80 may be switched between a plurality of positions for selecting a desired sensor 26, 28, or 30, whereby to vary the trigger temperature.

Cable network 18 extends between plugs 34 and 57 to interconnect modules 14 and 16. Cable network 18 (FIG. 1) includes a conventional plug 84 adapted to be received by female plug 34 (secured to module 14). Plug 84 leads to flanged coupling 86 via line 85. Plug 86 is adapted to be secured to a wall or other convenient truck trailer portion 88 whereby its exterior 89 is readily accessible. Similarly, control plug 56 leads through conventional line 62 to a flanged plug 92 secured to a wall or similar structure 94 forming part of the truck cab. Plug 92 is accessible exteriorly of the truck cab. An elongated, coiled, heavy duty cable 100 extends between the truck cab and the refrigerated compartment. Conductor 100 terminates in conventional plugs 102, and 104 which are respectively received by plugs 89, 92. When the cable network is interconnected in this manner, it will be apparent that the following circuit lines will be interconnected: 54 and 54A; 106 and 106A; 108 and 108A; and, 111 and 111A. Lines 106, 108 or 111 are selected by rotary switch 80 for interconnection via lines 114, 115 extending to mode switch 64.

In the "test" mode switch 64 interconnects line 120 with buss 54 via line 121. When line 120 is energized, alarm network 68 will be actuated. In the "off" mode lines 120, 126 are unconnected.

In the "alarm" mode line 120 is interconnected with line 114 which leads via line 115 to switch 80. Switch 80 interconnects line 115 to a desired thermostat 26, 28, or 30. If the thermostat selected by switch 80 is closed, (i.e. refrigerated compartment temperature is higher than thermostat trigger temperature) an alarm will sound. Circuit 14A in effect connects lines 54 and 115/114 when a thermostat is "closed". In the alarm mode line 126, which extends from buss 54, is also switched to line 128 to actuate power indicator transducer 78. It will thus be appreciated that a continuous indication of alarm functional status will be provided, independently of the operation of the alarm network 68 or "set" monitor 66 by third transducer 78.

To install the alarm system 12 cabinets 14 and 16 are first mechanically secured within the refrigerated compartment and the cab of the truck respectively. Terminal plugs 86, 92 may then be mechanically secured. After control cabinet 16 is installed, cable 44 is routed and appropriately interconnected with a conventional 12 to 14 volt direct current source. Preferably fuse 50 will then be installed by manipulation of fitting 50A (FIG. 1). Once the heavy duty, external cable 100 is installed by fitting plugs 102, 104 within plugs 89, 92 respectively the alarm system is ready for use.

Usually the thermostatic sensors 26, 28, and 30 (mounted externally upon cabinet 14) will not have had an opportunity to cool down initially. Therefore, set monitor 66 will be observed until "set" light 66 goes out. At this time it will be apparent that the sensor selected by rotary switch 80 will have cooled down below its trigger temperature. Also, it will be apparent that the set monitor function provided by indicator 66 will function completely independently of the setting of mode switch 64. Cable 100 must be installed for this "set" function to occur.

It will also be apparent that the basic power indicating means 78 may be actuated independently of alarm set indicator 66 by turning mode switch 64 to the "alarm" position.

When it is desired to test alarm network 68, comprising audio transducer 70 and light 69, switch 64 need merely be switched to the test mode wherein lines 120 and 121 are joined. Successful operation will of course depend upon the continuity of fuse 50 and the proper connection of power input cable 44. To aid in ease of mechanical installation, it will be appreciated that the test mode circuit will function completely independently of sensor module circuit 14A, so that the control cabinet 40 may be adequately installed prior to mounting of cabinet 14 and/or connection of cable network 18.

Once the apparatus has been installed, power and continuity are established, and the sensors 26, 28 and/or 30 have cooled to a temperature sufficient to maintain their contacts "open", continuous monitoring will occur if alarm mode switch 64 is switched to the alarm mode. As mentioned, line 128 will continuously energize power indicator 78 in this instance since line 128 completes a circuit with line 126 and buss 54. Also, it will be apparent that lines 114, 115 will interconnect alarm network 68 (via line 120) to rotary select switch 80 which will interconnect line 115 with lines 106, 108 or 111 whereby to select a desired sensor 26, 28, or 30. Thus, when temperature within the refrigeration compartment begins to rise, perhaps because of compressor failure or the like, alarm network 68 will be actuated when the contacts in the selected sensor 26, 28 or 30 close in response to rising temperature. Providing refrigerator repairs are effectuated, the unit may be reset by repeating the initial start up procedure previously described. In this mode "set" light 66 may simply then be observed until temperature again drops.

During the installation phase certain tests may be made with switch 64. It will be apparent that when mode switch 64 is switched into the "test" mode lines 120, and 121 will be joined, thereby actuating alarm network 68, provided fitting 48 has been interconnected with a power source. Also, it will be observed that this test mode will function either with or without interconnection with sensor module 14A. Thus elongated cable 18 is not required for the "test" mode operation. This will aid installation of the apparatus within truck cabs whether or not they are mated with any trailer during the installation phase. Similarly, it will be appreciated that mode switch 64 will actuate third indicator alarm means 78. When this third indicator means is actuated, it will provide a warning that the alarm subcircuit 16A is in the "alarm" mode, and of course it will provide a fail safe indication that voltage appears across buss lines 52, 54. It will also be apparent that this third sensor 78 will function, depending upon the setting of mode switch 64, entirely independently of sensor circuit 14A. Thus power test sensor 78 may be employed by operating mode switch 64 with or without the temperature sensors.

On the other hand it should be appreciated that the alarm set "indicator" 66 will be electrically isolated from mode switch 64 when switch 64 is in the "off" or "test" modes. At this time line 129 will be interconnected with one of the temperature sensors 26, 28 or 30 if and only if cable 18 has been installed to interconnect plugs 34, 57. The alarm "set" indicator 66 will thus provide an indication of refrigerator compartment temperature entirely independently of the mode selected by switch 64. It will also be apparent that the main power or third indicator means 78 will function independently of the interconnection of the sensor bank 14A with the alarm control circuit 16A providing that power is applied to input lines 49, 53.

The test mode dialed up by mode switch 64, wherein lines 120, 121 are joined to actuate transducer network 68, will also be entirely independent of the interconnection of temperature sensor thermostat circuit 14A. It will thus be apparent that appropriate diagnostic checks may be made by the installing technician within the cab prior to completing work within the refrigeration compartment, and/or prior to installation of cable network 18.

From the foregoing, it will be seen that this invention is one well adapted to obtain all the ends and objects herein set forth, together with other advantages which are obvious and which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A temperature-sensitive alarm system for over-the-road trucks having a cab and a towed, refrigerated trailer, the alarm system comprising:

a sensor bank adapted to be remotely secured within said refrigerated trailer, said sensor bank including a plurality of individual temperature sensing circuits for sensing temperature, each of said temperature sensing circuits characterized by a different preselected temperature setting above which they are triggered, said sensor bank housed within a rigid, metallic cabinet secured within said refrigerated trailer;

an alarm circuit housed within a rigid cabinet preferably disposed within the truck cab in a position observable by the driver of said truck;

elongated, electrical cable means for extending externally between said truck trailer and said truck cab for electrically connecting said sensor bank with said alarm circuit; and, wherein said alarm circuit comprises:

mode switch means for switching said alarm circuit between test, off, and alarm modes;

temperature switch means for coupling said alarm to a desired one of said temperature sensing circuits within said sensor bank;

first indicator means operable independently of said mode switch and coupled to a desired one of said sensing circuits by said temperature switch means for providing a warning during the time that said last mentioned sensing circuit is cooling after either initial installation of said sensor bank within said trailer or initial start-up of the refrigeration apparatus associated with said trailer, and operable, once proper cooling has occurred, to turn off whereby to alert said driver that the alarm system is "set";

second indicator means operable when said mode switch means switches said alarm circuit to said alarm mode for warning when temperature within said refrigerated trailer exceeds the temperature setting of the temperature sensing circuit selected by said temperature switch means, and actuated for test purposes when said mode switch means switches said alarm to said test mode, independently of the interconnection of said sensor bank with said alarm circuit; and, third indicator means for warning when said alarm circuit is in said alarm mode independently of said temperature select switch, independently of said first and second indicator means, and independently of the installation of said electrical cable means.

* * * * *